United States Patent [19]

Sugarman et al.

[11] Patent Number: 4,964,519

[45] Date of Patent: Oct. 23, 1990

[54] HOLDER FOR A DISPENSER FOR TAPE MARKER FLAGS

[75] Inventors: Louis Sugarman, Barrington; Max B. Dressler, Warwick, both of R.I.

[73] Assignee: Alcraft, Inc., Pawtucket, R.I.

[21] Appl. No.: 338,229

[22] Filed: Apr. 13, 1989

[51] Int. Cl.[5] ..... A47F 7/00

[52] U.S. Cl. ..... 211/50; 211/13; 206/214

[58] Field of Search ..... 211/50, 13, 69.1, 69.5; 206/214, 215, 425, 555

[56] References Cited

U.S. PATENT DOCUMENTS

| | | | |
|---|---|---|---|
| 4,176,743 | 12/1979 | Fitzpatrick | 206/214 |
| 4,616,755 | 10/1986 | Adolfsson | 211/50 X |
| 4,667,828 | 5/1987 | Samuelson | 206/555 |
| 4,696,399 | 9/1987 | Windsorski | 206/215 X |
| 4,716,948 | 1/1988 | Brissette | 206/214 X |
| 4,865,223 | 9/1989 | Huang | 206/214 X |

*Primary Examiner*—Robert W. Gibson, Jr.

[57] ABSTRACT

A holder which is receivable on a supporting surface and adapted for receiving and containing a dispenser for tape marker flags of a type which includes a body portion containing a supply of tape marker flags and an upwardly tapered tubular neck portion on the body portion through which tape marker flags can be individually dispensed as needed. The holder includes a housing comprising a top wall having an elongated slot therein which is dimensioned for snugly receiving the neck portion of a dispenser, and one or more retaining members in the housing which are adapted for retaining a dispenser in a position wherein the neck portion thereof extends upwardly through the slot in the housing.

7 Claims, 2 Drawing Sheets

HOLDER FOR A DISPENSER FOR TAPE MARKER FLAGS

BACKGROUND AND SUMMARY OF THE INVENTION

The instant invention relates to desk-top accessories and more particular to a holder which is receivable on a desk-top, counter-top or the like for holding and containing a dispenser for tape marker flags.

It has generally been found that tape marker flags can be effectively utilized for marking selected pages of various books, files, or pamphlets so that they can be readily located when desired. In this regard, a tape marker flag generally comprises an adhesive tape portion and a colored marker flag portion which is preferably made from an at least slightly flexible plastic material and attached to the tape portion. A tape marker flag of this type is adapted to be utilized by adhesively securing the tape portion thereof to the edge portion of a selected page of a book or the like so that the flag portion of the tape marker flag projects outwardly beyond the edge of the page. When a tape marker flag is assembled on a page in this manner the flag portion thereof is readily visible so that it can be utilized for quickly locating the selected page when desired.

It has recently been found that tape marker flags of the above described type can be effectively contained and marketed in dispensers from which marker flags can be individually dispensed as needed. In particular, it has been found that tape marker flags can be effectively dispensed from dispensers of a type comprising a container portion containing a supply of tape marker flags and including an enlarged substantially rectangular body portion and an upstanding tubular neck portion of elongated length and reduced upwardly tapering width on the body portion. However, it has been further found that dispensers for tape marker flags of this general type are often lost or misplaced and that for aesthetic reasons, they are sometimes considered unsuitable for placement on desktop surfaces.

The instant invention provides an effective holder for receiving and containing a dispenser for tape marker flags of the above described type in a manner wherein tape marker flags can be readily and easily individually dispensed as needed. In particular, the holder of the instant invention comprises a housing which is adapted to be received and supported on a substantially horizontal supporting surface, wherein the housing includes a top wall portion having an elongated slot therein and a side wall portion which depends from the top wall portion. The housing is adapted for removably receiving a dispenser for tape marker flags of the above described type and for maintaining the dispenser in a predetermined position therein wherein the body portion thereof is contained within the side wall portion of the housing and the neck portion of the dispenser extends upwardly through the slot in the top wall portion of the housing. The holder is preferably adapted for use in connection with a dispenser comprising a body portion which includes a top wall, a depending side wall and a peripheral flange which extends outwardly from the side wall in downwardly spaced relation to the top wall, and a neck portion which tapers slightly in its upward extent from the body portion. The means for releasably retaining a dispenser in the housing preferably includes means for frictionally engaging the side wall of the body portion, and the slot in the top wall portion of the housing is preferably dimensioned for frictionally receiving the neck portion of the dispenser in snug engagement therein. The means for releasably retaining the dispenser preferably further includes detent means for releasably retaining the flange of the dispenser in the housing and the housing preferably further comprises a bottom wall portion which releasably engages the side wall portion of the housing to retain it in a position wherein it substantially closes the bottom end of the housing. The holder preferably further includes a note pad tray which is integrally formed with the housing and includes a recessed central portion and a raised peripheral wall portion which extends substantially around the central portion, and it also preferably includes a note pad in the note pad tray. When the holder includes a note pad tray and a note pad it is preferably adapted for use in connection with a dispenser having a display card portion attached thereto. Specifically, the holder is preferably adapted so that the display card portion of the dispenser is receivable beneath the note pad tray when the dispenser is assembled in the housing.

Accordingly, it is a primary object of the instant invention to provide an effective desk-top holder for a dispenser for tape marker flags.

Another object of the instant invention is to provide an effective holder for a dispenser for tape marker flags comprising a housing including a top wall having an elongated slot formed therein, wherein the housing is adapted for receiving a dispenser so that the neck portion thereof extends upwardly through the slot in the housing.

An even further object of the instant invention is to provide an effective holder for a dispenser for tape marker flags including a housing which is adapted for receiving and containing the dispenser and a note pad tray which is integrally formed with the housing.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
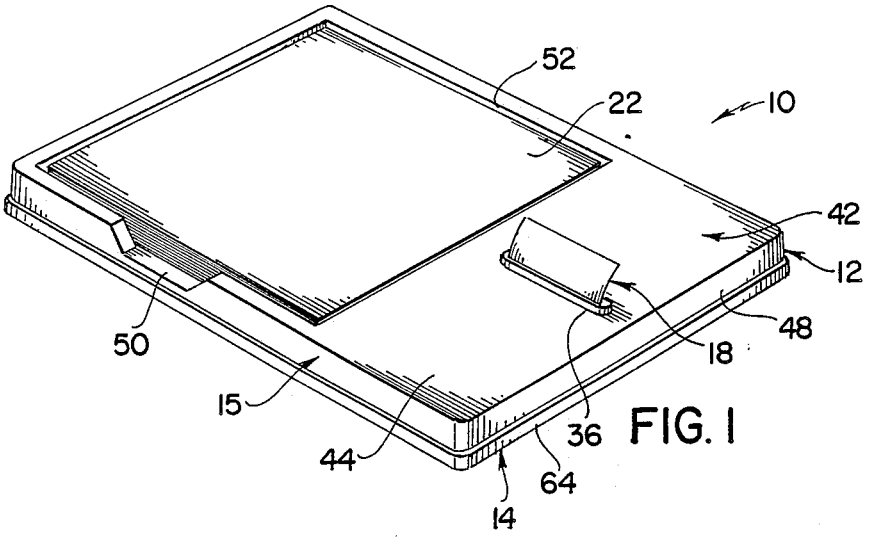
FIG. 1 is a perspective view of the holder of the instant invention with a dispenser received therein.
Figure 2:
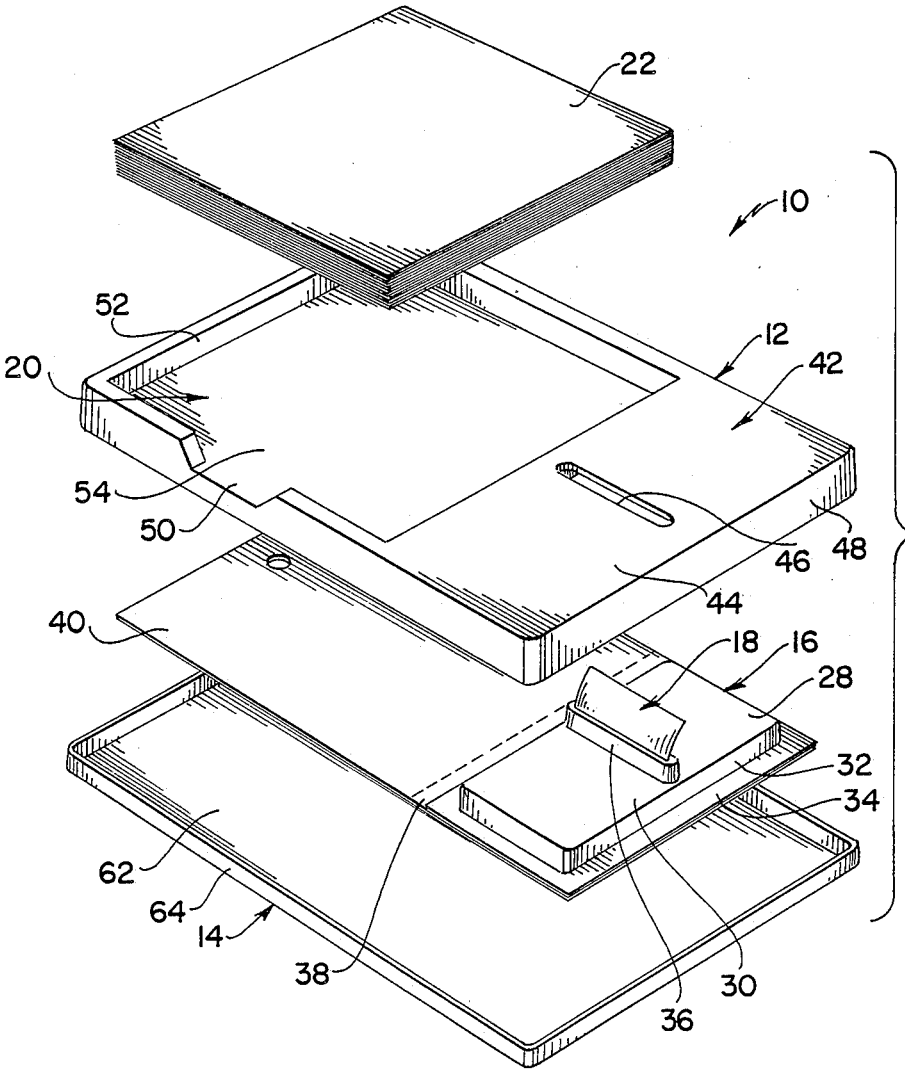
FIG. 2 is an exploded perspective view thereof.

Referring now to the drawings, the holder for a dispenser for tape marker flags of the instant invention is illustrated in FIGS. 1–5 and generally indicated 10 in FIGS. 1 and 2. The dispenser 10 includes a top portion generally indicated at 12 and a bottom portion generally indicated at 14 which is receivable in engagement with the top portion 12 so that it cooperates therewith to define a substantially enclosed housing 15 which is adapted for receiving and containing a dispenser generally indicated at 16 containing a supply tape marker flags 18. More specifically, the top portion 12 and the bottom portion 14 are adapted so that when the dispenser 16 is received in the housing 15 the tape marker flags 18 can be individually dispensed from the dispenser 16. The top portion 12 is further adapted so that it includes a note pad tray portion generally indicated at 20 which is to dimensioned for receiving a note pad 22 therein so that individual sheets of the note pad 22 can be removed from the tray portion 20 as needed.

Figure 6:
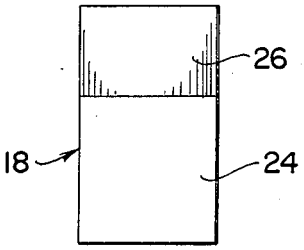
FIG. 6 is a perspective view of a tape marker flag.

The dispenser 16 is illustrated most clearly in FIG. 2 and it preferably comprises a dispenser of a type manufactured by 3M Corporation of St. Paul, Minnesota which is operative for dispensing POST-IT (3M Corporation TM) tape marker flags 18 of the type illustrated in FIG. 6 comprising a tape portion 24 and a marker portion 26. The dispenser 16 includes an enlarged body portion 28 of generally rectangular configuration including a top wall 30, a depending peripheral side wall 32 and a peripheral flange 34 which extends outwardly from the bottom end of the side wall 32, and an open ended tubular neck portion 36 which extends upwardly from the top wall 30. The neck portion 36 is slightly tapered in its upward extent and it is of elongated cross sectional length and reduced cross sectional width so that tape marker flags 18 can be individually drawn outwardly therethrough as needed. The neck portion 36 is integrally formed with the top wall 30, the side wall 32 and the flange 34 from a suitable plastic material and a cardboard bottom wall 38 is adhered to the underside of the flange 34 in order to enclose the interior of the body portion 28. The bottom wall 38 is integrally formed with a display card portion 40 which is adapted to be received on a display hanger in a marketing display. A supply of the tape marker flags 18 is assembled in the interior of the body portion 28 so that each time one flag 18 is drawn outwardly through the neck portion 36 another marker flag 18 is moved into the dispensing position illustrated in FIGS. 1 and 5 wherein it projects outwardly a sufficient distance from the neck portion 36 to enable a user to grasp the marker portion 26 thereof.

The top portion 12 of the holder 10 includes the note pad tray portion 20 and a housing portion generally indicated at 42 which is integrally formed with the note pad tray portion 20 from a suitable plastic material. The housing portion 42 comprises a top wall 44 having an elongated slot 46 formed therein and a side wall portion 48 which defines the outer perimeter of the housing portion 42 and also extends around the perimeter of the tray portion 20. The portion of the side wall portion 48 which extends around the perimeter of the tray portion 20 has an enlarged access notch 50 formed therein and an inner peripheral wall 52 and a bottom wall 54 cooperate to define the interior of the tray portion 20.

Figure 3:
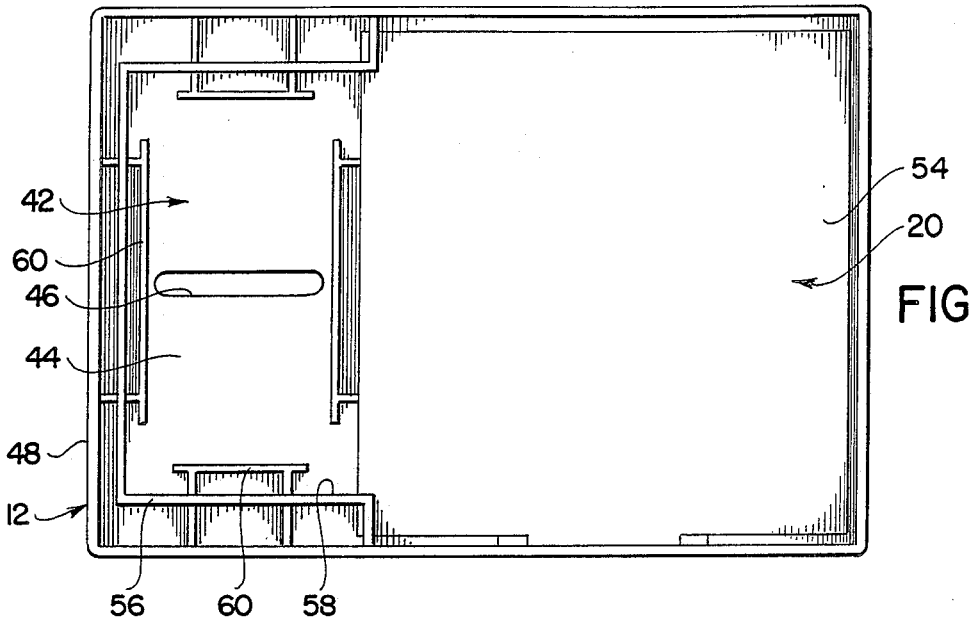
FIG. 3 is a bottom plan view of the top portion of the holder.
Figure 4:
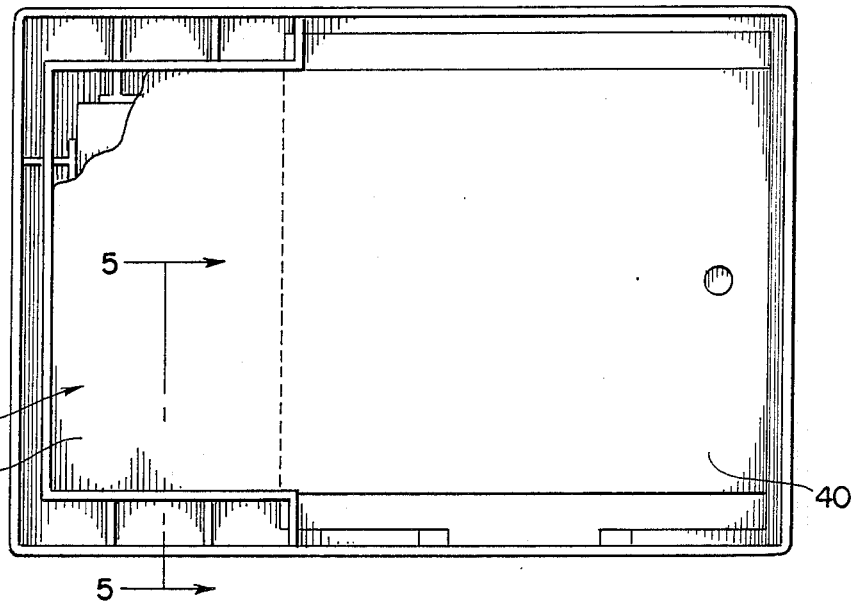
FIG. 4 is a similar view with a dispenser received in the holder.
Figure 5:
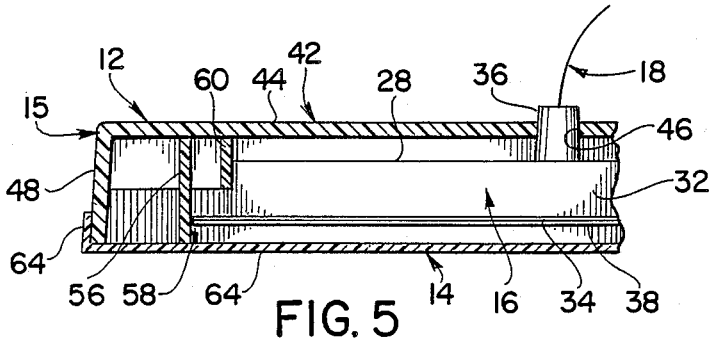
FIG. 5 is a fragmentary sectional view taken along line 5—5 in FIG. 1.

Referring to FIGS. 3 and 4 the underside of the top portion 12 is illustrated. As will be seen, a retaining wall 56 having a detent rim 58 (see FIG. 5) at the lower end thereof is formed in the interior of the housing portion 42 in inwardly spaced relation to the side wall portion 48. Also formed in the interior of the housing portion 42 but in inwardly spaced relation to the retaining wall 56 is a plurality of side wall engagement members 60. The side wall engagement members 60 are positioned for frictionally engaging the side walls 32 of the dispenser 16 whereas the retaining wall 56 is constructed so that the detent rim 58 thereon is engageable with the edge portions of the cardboard bottom wall 38 adjacent the flange portion 34; and accordingly, the retaining wall 56 and the engagement walls 60 are adapted to cooperate for releasably retaining the dispenser 16 in the housing portion 42. The slot 46 in the top wall 44 is dimensioned for receiving the neck portion 36 therethrough so that the side edges of the slot 46 frictionally engage the neck portion 36 to wedge it in the slot 46 in order to further retain the dispenser 16 in the housing portion 42.

The bottom portion 14 is preferably also integrally molded from a suitable pectic material and it includes a bottom wall 62 and an upstanding peripheral side wall 64. The bottom portion 14 is dimensioned so that it is receivable on the top portion 12 with the inner side of the peripheral side wall 64 received in frictional engagement with the outer side of the side wall portion 48 in order to releasably retain the bottom portion 14 on the top portion 12.

For use of the holder 10 the bottom portion 14 is removed from the top portion 12 and a dispenser 16 is assembled in the top portion 12 so that the tubular neck portion 36 of the dispenser 16 is received in wedged engagement in the slot 46 and so that one of the tape marker flags 18 extends upwardly above the top wall 44. When the dispenser 16 is assembled with the top portion 12 in this manner the engagement members 60 frictionally engage the side wall 32 of the dispenser 16 to frictionally retain the dispenser 16 in an assembled position with the top portion 12 and the detent rim 58 engages the bottom wall 38 to further retain the dispenser 16 in the assembled position in the top portion 12. Still further, the display card portion 40 extends beneath the note pad tray 20 as illustrated. Once the dispenser 16 has been assembled with the top portion 12, the bottom portion 14 is assembled with the top portion 12 in order to fully enclose the interior of the holder 10 and the note pad 22 is assembled in the note pad tray 20. The holder 10 with the dispenser 16 therein can then be placed on a supporting surface, such as a desk-top so that the tape flags 18 in the dispenser 16 can be individually dispensed as needed and also so that individual sheets of paper can be dispensed from the note pad 22 as needed.

It is seen therefore that the instant invention provides an effective holder for a dispenser for tape marker flags. The holder 10 is adapted to effectively and neatly contain the dispenser 16 in a manner which permits the tape flags 18 to be individually dispensed as needed. The holder 10 is further operative for holding and containing the note pad 22 so that the individual sheets thereof can be dispensed as needed. Accordingly, it is seen that the holder 10 represents a significant improvement in the art relating to desk-top accessories which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A holder for a dispenser for tape marker flags, wherein the dispenser includes a container portion having an enlarged body portion and an upwardly extending, open ended, tubular neck portion of elongated cross sectional length and reduced cross sectional width on said body portion, and a supply of tape marker flags in said body portion, said marker flags being individually dispensable through said neck portion, said holder comprising a housing which is adapted to be received and supported on a substantially horizontal supporting surface, said housing including a top wall portion having an elongated slot therein and a side wall portion depending from said top wall portion, said dispenser being removably receivable in a predetermined position in said housing wherein said neck portion extends upwardly through said slot, and means releasably retaining said dispenser in said predetermined position in said housing.

2. In the holder of claim 1, said tubular neck portion further characterized as having an upwardly tapering width, said slot having elongated opposite side edges and being dimensioned so that said neck portion is receivable in wedged engagement between said side edges, said releasable retaining means comprising said side edges.

3. In the holder of claim 1, said dispenser body portion including a body portion top wall and a depending body portion side wall, said releasable retaining means including means for frictionally engaging said body portion side wall to retain said dispenser in said predetermined position.

4. In the holder of claim 1, said dispenser body portion including a body portion top wall, a depending body portion side wall, and a peripheral flange extending outwardly from said body portion side wall in downwardly spaced relation from said body portion top wall, said releasable retaining means including detent means releasably communicating with said flange for retaining said body portion in said housing.

5. The holder of claim 1, further comprising a bottom wall portion releasably engaging said housing side wall portion to substantially enclose the interior of said housing said holder being adapted to be supported on said bottom wall portion when said holder is received on said supporting surface.

6. The holder of claim 1 further comprising a note pad tray integrally formed with said housing, said note pad tray including a recessed bottom wall portion and a raised peripheral wall portion extending substantially around said bottom wall portion and a note pad in said note pad tray.

7. In the holder of claim 6, said dispenser including a body portion top wall, a depending body portion side wall and a body portion bottom wall on said body portion side wall, said body portion top wall, said body portion side wall and said body portion bottom wall cooperating to define a substantially enclosed cavity in said body portion for containing said supply of tape marker flags, said dispenser further including a display card portion attached to said body portion bottom wall and extending outwardly from said body portion, said note pad tray being dimensioned and positioned so that said display card portion is received beneath said note pad tray when said dispenser is in said predetermined position.

* * * * *